United States Patent [19]

Komp

[11] Patent Number: 4,962,658

[45] Date of Patent: Oct. 16, 1990

[54] METHOD AND APPARATUS FOR STRAIGHT DRAWING A PIPE

[75] Inventor: Karl-Heinz Komp, Aachen, Fed. Rep. of Germany

[73] Assignee: Firma Schumag AG, Aachen, Fed. Rep. of Germany

[21] Appl. No.: 387,861

[22] Filed: Jul. 31, 1989

[30] Foreign Application Priority Data

Aug. 3, 1988 [EP] European Pat. Off. ..... 88112596.7

[51] Int. Cl.[5] ..... B21C 1/24

[52] U.S. Cl. ..... 72/283; 72/189

[58] Field of Search ..... 72/283, 282, 274, 291, 72/189, 197, 198

[56] References Cited

U.S. PATENT DOCUMENTS

| | | | |
|---|---|---|---|
| 2,155,437 | 4/1939 | Moore et al. | 72/283 |
| 2,600,254 | 6/1952 | Lysobey | 72/198 |
| 3,812,702 | 5/1974 | Benteler et al. | 72/282 |

FOREIGN PATENT DOCUMENTS

| | | | |
|---|---|---|---|
| 2623385 | 12/1977 | Fed. Rep. of Germany | 72/283 |
| 3405641 | 8/1985 | Fed. Rep. of Germany | 72/283 |

*Primary Examiner*—Daniel C. Crane

*Attorney, Agent, or Firm*—W. G. Fasse; D. H. Kane, Jr.

[57] ABSTRACT

Pipes are straight drawn for reducing the pipe diameter and the pipe wall thickness. The drawing is performed intermittently through a plurality of drawing stages, each including a drawing plate having a drawing nozzle or opening through which the pipe must pass. Individual, separate drawing mandrel sections forming a set and corresponding in number to the plurality of drawing plates, are inserted in proper sequence into the pipe to be drawn. The insertion is such that the mandrel sections are located, prior to the begin of the drawing operation, between a pulling end of the pipe and a first dent. The smaller diameter mandrel sections first pass through the hole in the drawing plate and only the largest dimeter mandrel section is held in place by the first drawing plate for squeezing the pipe through that drawing plate. The smaller diameter mandrel sections travel along with the pipe as it is being drawn through the plates one after the other, whereby each plate keeps its respective mandrel section in place. A denting tool is so positioned and arranged for cooperation with the drawing tool that further dents are formed in the pipe close to, but behind the last mandrel section that passed through the nearest nozzle or drawing plate. Thus, the next dent is formed in a pipe portion which has already a reduced wall thickness while any hollow drawing is minimized. Thus, each drawing plate cooperates with its own independent mandrel section and with its own denting mechanism. At least one denting mechanism is arranged downstream of each drawing plate as viewed in the drawing direction of the pipe.

14 Claims, 5 Drawing Sheets

1
2
3
4
5
6
9
10
11

1
3
4
5
7
8
9
11
12

METHOD AND APPARATUS FOR STRAIGHT DRAWING A PIPE

FIELD OF THE INVENTION

The invention relates to a method and apparatus for straight drawing a pipe for reducing the pipe diameter and the wall thickness of the pipe. Such drawing operations are performed in several stages. Internal mandrels are used for this purpose.

BACKGROUND INFORMATION

German Patent Publication No. (DE-OS) 2,623,385 disclose and apparatus for performing the method. The known method requires for its performance relatively complicated drawing mandrels which are interconnected with one another, for example, by plug-in connections or similarly operating connections. The structure required for the interconnection of the mandrels is not only complicated, it is also expensive.

Another disadvantage of conventionally interconnected drawing mandrels is seen in the fact that a set of such interconnected mandrels remains inside the pipe in the nozzle area until a further indentation is made. This fact requires that the spacing between individual mandrel sections and thus the size, especially the length of the intermediate connecting components, is sufficiently large in order to transport the next smaller mandrel section through the drawing station sufficiently far in the forward direction so that between two neighboring mandrel sections of different diameters a dent can be made at the drawing plate or nozzle. As a result, the space available for the denting tool is very limited. Another disadvantage of this arrangement is the fact that due to this limited space available for the denting tool, a substantial length of pipe will be drawn in which merely the diameter has been reduced by the drawing plate or nozzle but in which the wall thickness of the pipe has not been reduced. This is so because the denting can be made only when the mandrel section with the next smaller diameter has assumed the position in the zone of reduced wall thickness as produced by the preceding larger diameter drawing nozzle in the drawing plate.

OBJECTS OF THE INVENTION

In view of the foregoing it is the aim of the invention to achieve the following objects singly or in combination:

- to provide a method of the type described above which will provide more space for the denting mechanism while simultaneously reducing the drawing length during which the wall thickness is not reduced, in other words, to reduce the socalled hollow drawing; and
- to use drawing mandrels which are not interconnected with one another at all and to provide an apparatus for this purpose.

SUMMARY OF THE INVENTION

According to the invention there is provided a method for straight drawing pipes to reduce the pipe diameter and the pipe wall thickness which method is characterized in that prior to the begin of the drawing a plurality of drawing mandrel sections are introduced into the pipe to be drawn without any interconnection between the mandrel sections. Thus, the mandrels are located between a pulling end of the pipe and a dent in the pipe, whereby the smallest diameter mandrel section is located closest to the pulling end of the pipe while the largest diameter mandrel section is located closest to the dent or denting. In the following drawing operation the mandrel sections remaining after each drawing step are transported along with the respective drawn pipe section. The next denting is then applied to the pipe section of reduced pipe wall thickness and as close behind the last mandrel section having passed through the nozzle of the preceding drawing plate, The present method can be primarily practiced in two ways. In one way the pipe end is flattened to form a pipe end to which a pulling or drawing tool can be secured. Thereafter, the mandrels smallest diameter first, are inserted into the pipe and the first dent is made upstream of the largest diameter mandrel section as viewed in the drawing or pulling direction. In another way, the first dent can be made near a pipe end, whereupon the mandrel sections are individually inserted, large diameter first, and thereafter, the pipe end is flattened for the attachment of a drawing tool. In both instances the individual mandrel sections are not connected with one another which is an important advantage of the invention. The mandrel sections merely rest unconnected and loosely in the pipe, however, in the proper sequence, namely, smallest diameter first and largest diameter last as viewed in the drawing direction.

Once the pipe has been prepared and the mandrels nave been inserted as just described, the pipe is transported first through the drawing plate with the largest nozzle, whereby the largest diameter mandrel section is pulled into the drawing position and the other nozzle sections with smaller diameters are being transported through the nozzle or hole in the drawing plate. The largest diameter mandrel section now cooperates with the respective drawing nozzle in reducing the pipe wall thickness. The smaller diameter mandrel sections now do not remain in position because they are not connected to the largest diameter mandrel section. Rather, the smaller diameter mandrel sections travel along with the portion of the pipe which has received a pipe diameter change, but not a wall thickness change. This feature has the advantage that space is provided between the preceding mandrel section and the next following smaller diameter mandrel section for the denting which will pull the next following mandrel section into the drawing position for cooperation with the next smaller diameter nozzle in the next drawing plate. Since the preceding mandrel sections are located in the pipe zone not having a reduced wall thickness, it is possible to place the next denting within a short pipe length having a reduced wall thickness. Thus, it is no longer necessary to pull a substantial length of pipe with a not reduced wall thickness as a so-called hollow drawing. Such hollow drawing always takes place when the pipe is pulled through the drawing nozzle or hole without the cooperation of a respective mandrel section. Thus, the invention has two main advantages. It achieves a better result as compared to the prior art and it achieves that result with less complicated drawing mandrels. The better result is seen in that hollow drawing is reduced. A further advantage is seen in that now sufficient space is provided for the denting tool.

This further advantage is also quite important because it permits structuring the denting mechanism so that the denting tool or bolt proper can be suitably moved along with the movement of the work piece, namely the pipe. Thus, stopping the drawing operation for making the dent is no longer necessary. Additionally, tearing or otherwise damaging the pipe is avoided even though the indenting takes place while the drawing speed is maintained.

The apparatus according to the invention is characterized in that it has at least two drawing plates each with a nozzle arranged in sequence in the drawing direction. Each drawing plate plate is equipped with its pipe denting tool. Hence, there are as many denting tools as there are drawing plates. The mandrel sections are independent of one another because they are not connected to each other. The denting tool is so controlled that a denting bolt is activated at the earliest when the pipe section or portion that has been hollow drawn as explained above, has passed the denting tool so that a denting will take place in a pipe section having already a reduced wall thickness.

BRIEF DESCRIPTION OF THE DRAWINGS

In order that the invention may be clearly understood, it will now be described, by way. of example, with reference to the accompanying drawins, wherein.

DETAILED DESCRIPTION OF PREFERRED EXAMPLE EMBODIMENTS AND OF THE BEST MODE OF THE INVENTION

Figures 1, 2, 3:
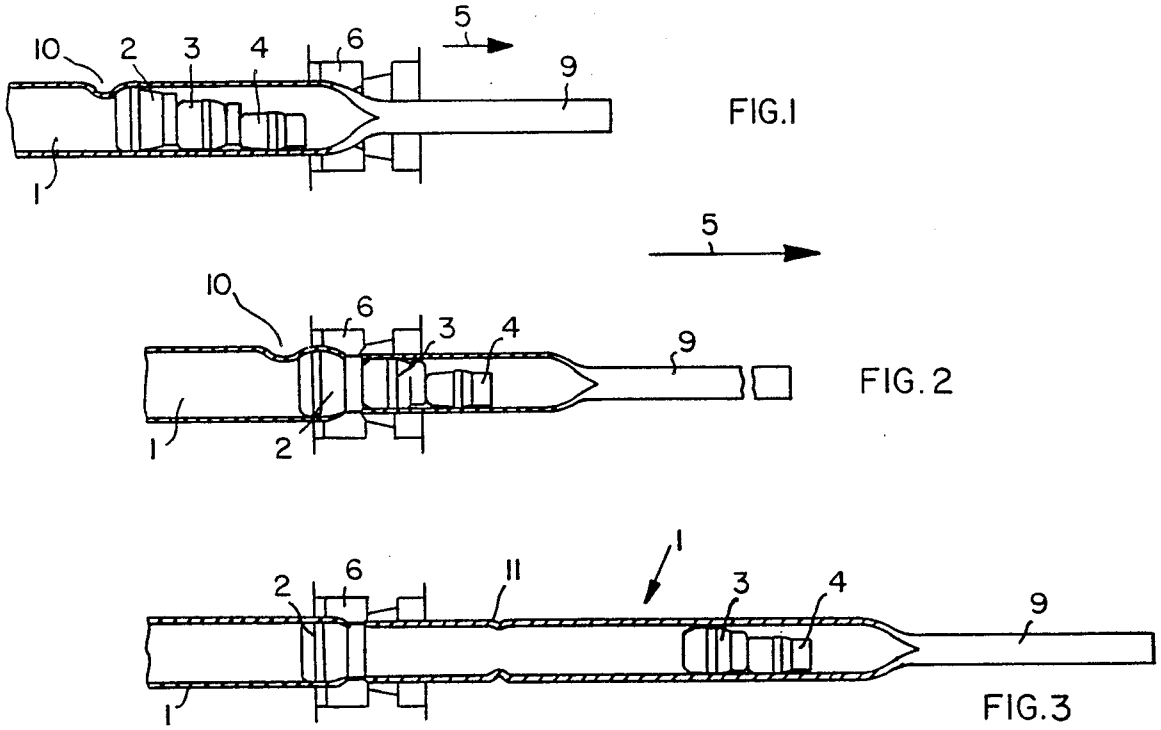
FIGS. 1 to 6 illustrate schematically different stages in the drawing process.

FIG. 1 illustrates the beginning of a drawing operation. One end 9 of a pipe 1 has, for example, been flattered to enable the gripping of the flat end 9 by a drawing tool 20. Any conventional means may be employed to grip the pipe end to pull it in the direction of the arrow 5 for the purpose of reducing the pipe diameter and the pipe wall thickness. As shown in FIG. 1, the pipe end 9 has already been pulled through the nozzle of the drawing plate 6. Inside the pipe 1 there are located three drawing mandrel sections 2, 3, and 4, whereby section 2 has the largest diameter, section 3 has an intermediate diameter, and section 4 has the smallest diameter. According to the invention, these mandrel sections are not interconnected with each other. Thus, the mandrel sections are independent of one another, except that they are arranged in the proper diameter sequence so that the smallest diameter mandrel 4 is always first in the pulling direction. Just behind the largest diameter mandrel section 2 a dent 10 is provided which holds the mandrel section 2 in place during the pulling operation as shown in FIGS. 2 and 3. The dent 10 disappears as a result of the pulling.

When the pulling of the pipe 1 begins in the direction of the arrow 5, the sections 3 and 4 with their smaller diameters pass through the hole in the nozzle of the drawing plate 6, whereby simultaneously the pipe diameter is reduced. However, at this stage, the wall thickness of the pipe is not yet reduced. This portion of the drawing being referred to as the "hollow drawing".

When the mandrel section 2 reaches the nozzle of drawing plate 6 the dent 10 makes sure that the mandrel section 2 will cause the pipe 1 to bear against the walls of the nozzle in the drawing plate 6 as shown in FIG. 2. When the drawing continues, the mandrel section 2 is pulled into the drawing plate 6 to such an extent that it now sits in the drawing position, whereby the wall thickness of the pipe 1 is reduced as shown in FIG. 3. FIG. 3 shows that the mandrel sections 3 and 4 are still present in the leading portion of the pipe 1. It will be noticed that the wall thickness reduction begins immediately upstream of the mandrel section 3 having regard to the drawing direction 5. Thus, the length of the hollow drawn pipe portion is kept as short as possible, which is advantageous. The next dent 11 may now be set in a portion of the pipe 1 having already a reduced wall thickness. The dent 11 may be set as close as possible even immediately upstream of the mandrel section 3. As shown in FIG. 3 the spacing between the dent 11 and the mandrel section 3 is exaggerated. The dent 11 may even be a groove all around the pipe. However, normally that is not necessary.

Figures 4, 5, 6:
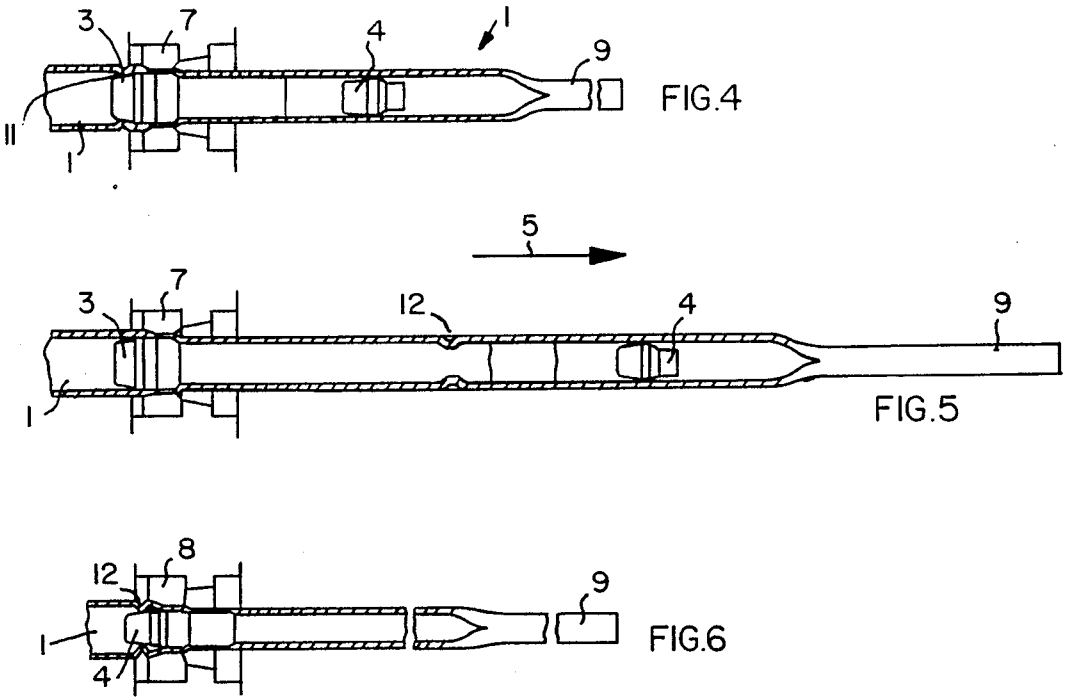
Figure 7:
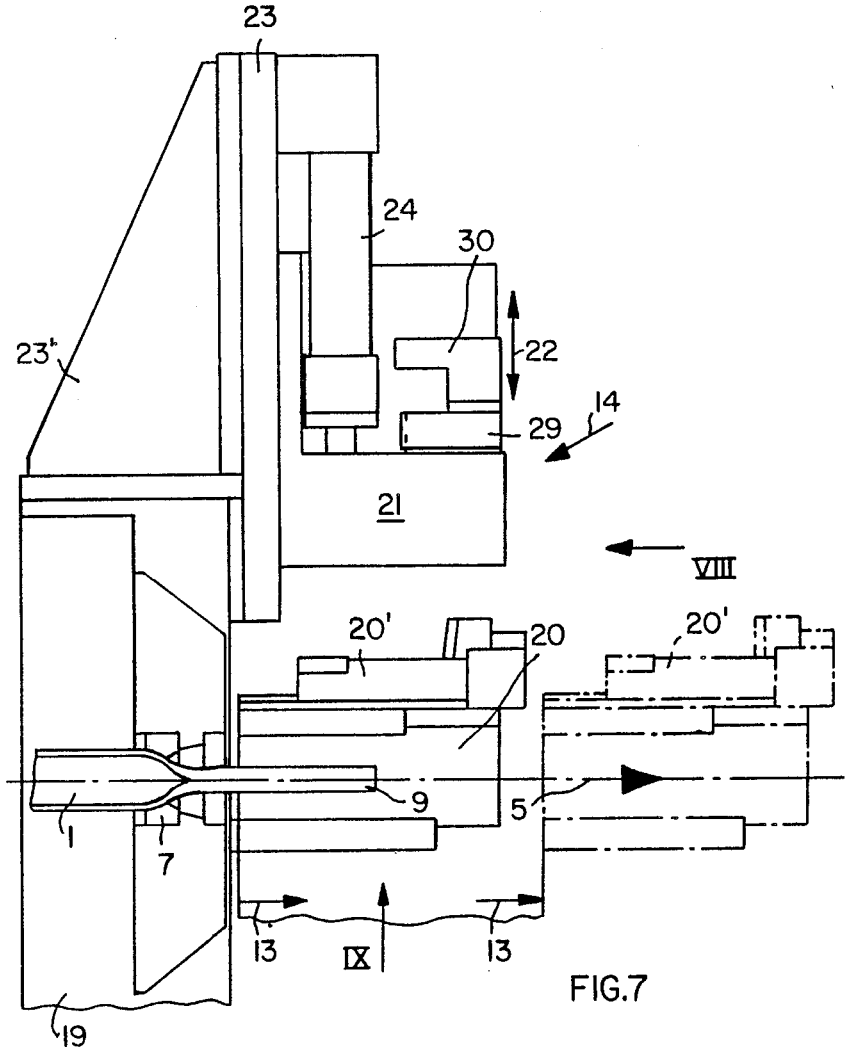
FIG. 7 is a side view of a drawing apparatus showing the components essential for explaining the invention including the denting mechanism, a drawing plate with its nozzle, and the drawing slide.

FIG. 4 shows that the outer diameter of the pipe 1 is now further reduced directly upstream of the pulling end 9 so that the mandrel section 3 is held in place between the dent 11 and the drawing plate 7. As the drawing continues, the pipe portion with the not yet reduced wall thickness is pulled through the nozzle of the drawing plate 7 while simultaneously reducing the outer diameter of the pipe 1 so that the mandrel section 3 travels, so to speak, backward into the zone of the pipe 1 having the reduced wall thickness. The dent 11 may be so positioned that the mandrel section 3 is immediately pulled into the nozzle plate 7 for further reducing the pipe wall thickness. This is the position shown in FIG. 4. The pulling or drawing is now continued and the dent 12 is made as shown in FIG. 5. Here again, the dent can be made according to the invention in a pipe portion having a further reduced wall thickness. The dent 12 will make sure that the smallest diameter mandrel section 4 which is stopped by the nozzle plate 8, is pulled into the drawing position so that the drawing nozzle plate 8 will cause a further reduction of the wall thickness of the pipe 1 as shown in FIG. 6. The dents 10, 11, and 12 will be removed as a result of the drawing.

FIGS. 7 to 11 illustrate a straight drawing apparatus 19 including a denting mechanism 14 according to the invention. Straight drawing machines with intermittently operating drawing slides 20 are known in the art. Therefore, the conventional components of the apparatus shown are only illustrated schematically. The straight drawing apparatus 19 comprises a drawing plate 7 with a nozzle, whereby the pipe 1 with its flattened end 9 is shown to have entered the hole or nozzle opening in the drawing plate 7. A conventional gripper 20' for gripping the pipe end 9 is mounted on a drawing slide 20 for pulling the pipe 1 in the direction of the arrow 5 by a drawing stroke 13. This drawing stroke 13 pulls the pipe 1 into the nozzle plate 7 as is conventional.

The denting mechanism 14 is mounted to vertical guides 23 for an up and down movement as indicated by the arrow 22. The guides 23 are conventionally mounted to a machine frame 23'. The denting mechanism 14 comprises a stroke head 21 driven by a vertical drive 24 such as a piston cylinder device. Although the denting mechanism 14 is shown to be movable in the vertical direction, the mechanism 14 could also be mounted for movement in other radial directions relative to the drawing direction 5. In any event, the stroke head 21 faces the pipe 1 and carries denting tools 15 and 16 shown in more detail in FIGS. 8 to 11. The denting tool 15 is tiltably mounted on a shaft 15' having a tilting axis 25. The denting tool 16 is tiltably mounted on a shaft 16' having a tilting axis 26. The tilting motion of the denting tools 15 and 16 is accomplished, for example, by a tilting drive 30 which may also be a hydraulic piston cylinder device operatively connected to the respective tilting shaft by appropriate crank levers 30'. A gear rim segment 28 is rigidly secured to the shaft 15' on the upper side of the stroke head 21. The gear rim segment 28 meshes with a similar gear rim segment 29 rigidly mounted on the tilting shaft 16'. Thus, a tilting motion of the gear rim segment 28 is transmitted in the opposite rotational direction onto the gear rim segment 29, thereby transmitting a denting force to the denting tools 15, 16 respectively. Thus, these tools move in opposite directions as best seen in FIGS. 9, 10, and 11, wherein the segment 28 rotates counterclockwise while the segment 29 rotates clockwise.

Each of the denting tools 15 and 16 comprises a respective denting bolt 17 and 18 facing toward the pipe 1 to be dented. These bolts 17 and 18 are so located that their spacing from each other in the position shown in FIG. 10 is less than the outer diameter of the pipe 1 to form the dent when the bolts 17 and 18 are located in the position of FIG. 10. The denting is performed during the first drawing or pulling in stroke 13 and is completed before the end of the stroke 13 so that once the drawing slide 20 has advanced sufficiently in the drawing direction 5, the denting mechanism 14 will assume the working position as shown in FIG. 10 positioned by the driving mechanism 24 and in synchronism with the tilting drive mechanism 30.

Figure 8:
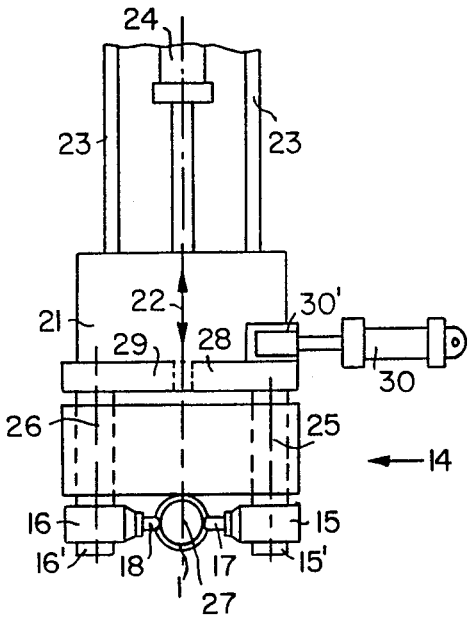
FIG. 8 is a view in the direction of the arrow VII in FIG. 7.
Figure 9:
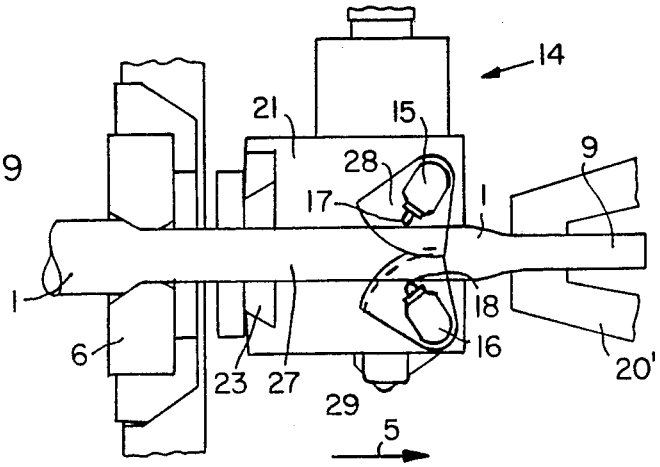
FIG. 9 is a view in the direction of the arrow IX in FIG. 7 illustrating the beginning of a denting step.
Figure 10:
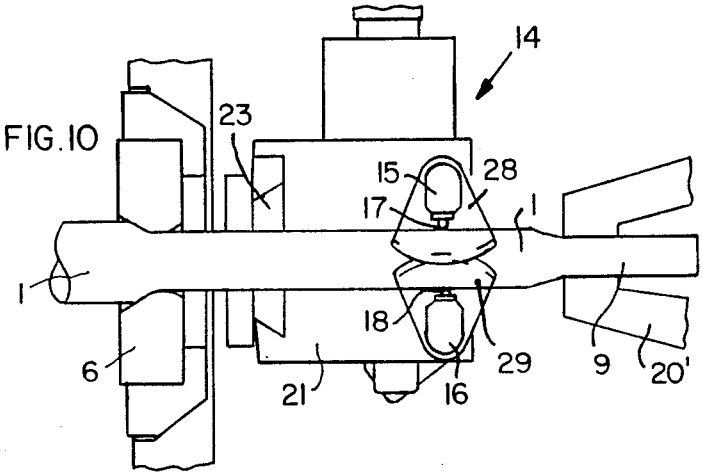
FIG. 10 is a view similar to that of FIG. 9 illustrating an intermediate point of time in a denting step.
Figure 11:
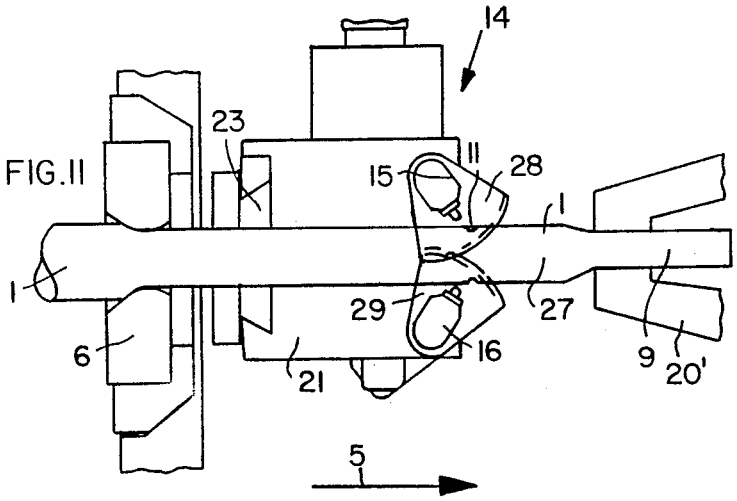
FIG. 11 is a view similar to that of FIGS. 9 and 10 illustrating the completed denting step.

In FIGS. 9, 10, and 11 the two gear rim segments 28 and 29 are so illustrated as if they are located below the pipe 1. However, in reality the segments 28 and 29 are located above the work piece 1 and only the denting tools 15 and 16 with their bolts 17 and 18 project below the stroke head 21, please compare FIG. 8 with FIG. 9. The denting tools 15 and 16 are not shown in FIG. 7 for simplicity's sake.

With the denting tools 15 and 16 and the segments 28 and 29 in the position shown in FIG. 9, the pulling drive for the drawing slide 20 and the tilting drive 30 for the segments 28 and 29 are operated with such a speed that the circumferential speed of the segments 28 and 29 corresponds to the linear drawing speed of the pipe 1. Thus, the bolts 17 and 18 move toward the surface of the pipe 1 until they form the dent 11 when the bolts 17 and 18 are in the position of FIG. 10. FIGS. 8 and 10 show the bolts 17 and 18 in the denting position.

The movement of the pipe 1 in the direction of the arrow 5 and the movement of the denting tools 15 and 16 into the position shown in FIG. 11 now continues. Thereafter, the segments 28 and 29 with their respective denting tools are returned into the position shown in FIG. 9. In other words, the entire denting mechanism 14 assumes again the position shown in FIG. 7.

It is an advantage of the invention that the denting operation does not require a stopping of the pulling or drawing operation. Due to the synchronized movement of the pulling gripper 20' on its slide 20 and the segments 28 and 29, any overloading of the pipe 1 due to the simultaneous drawing and denting is avoided. Thus, the danger of tearing the pipe 1 by a rigidly arranged denting tool is eliminated.

Due to the above mentioned synchronization between the several drives, there is no further need for establishing the proper point of time for the denting. The denting takes place automatically at the proper time and in the proper position for the next smaller diameter drawing mandrel section, thereby minimizing any hollow drawing. Since the denting takes place within a tilting movement, any undesirable loading of the pipe 1 is avoided and damages to the pipe 1 are respectively avoided.

By applying two denting bolts simultaneously on opposite sides of the pipe 1, an undesirable bending loading of the pipe 1 is avoided during the denting.

By arranging an independent, that is, nonconnected drawing mandrel section 2, 3, 4 for cooperation with a respective drawing nozzle plate 6, 7, or 8, it is assured that the drawing mandrel sections of smaller diameter will move forward with the drawing progress of the pipe 1. Thus, the smaller diameter mandrel sections will not stay put near the last drawing plate until the indentation. This feature of the invention makes it possible that the respective denting can take place far enough away from the last drawing plate to thereby provide sufficient space for the mounting of a denting tool that either tilts along with the drawing motion or that travels along with the drawing motion. Yet, according to the invention the denting can be accomplished at a suitably short distance behind the last drawing mandrel section so that unnecessary hollow drawing is avoided. It must, however, be made certain that a sufficient length of pipe having already a reduced wall thickness is advanced prior to the denting so that between the newly formed dent and the hollow drawn section of the pipe there is sufficient space for the next mandrel section to become effective with the next drawing plate. Without such spacing the next drawing plate in a state would result in an excessive reduction in the pipe wall thickness, thereby raising the possibility that the pipe 1 is damaged, or the dent could not pull the drawing mandrel section into the working position within the next drawing plate.

It is especially advantageous when the denting mechanism or at least the stroke head of the denting mechanism is mounted in a straight guide 23 so that it can be moved toward the pipe 1 and away from the pipe 1, especially in a radial direction, whereby the construction is simplified and space is provided for easy access to the denting tools. Additionally, the linear displacement is easily accomplished and proper positioning is assured. However, rather than moving the denting tool in a linear manner as described above, the stroke head could also be mounted for a tilting motion to bring it into its working position.

The gear rim segments 28 and 29 which coordinate the movement of the respective denting tools 15 and 16 make sure that the proper motion sequence of the two denting bolts 17 and 18 is assured. This feature also avoids a further tilting drive, or rather a separate tilting drive for each denting tool and has the added advantage that the meshing of the gear rims automatically enforces the synchronization of the movement of the two denting tools. Further, the denting mechanism can be of relatively light construction because the denting force is provided by the drawing motion of the pipe 1.

Although the above example embodiment has been described with reference to the use of three independent mandrel sections cooperating with three respective drawing plates, it is to be understood that more or fewer nozzles and mandrel sections can be employed for practicing the present invention.

Although the invention has been described with reference to specific example embodiments, it will be appreciated that it is intended to cover all modifications and equivalents within the scope of the appended claims.

What I claim is:

1. A method for straight drawing a pipe, to reduce the pipe diameter and pipe wall thickness, comprising the following steps:

(a) providing a number of drawing mandrel sections forming a set in which the mandrel sections are without any interconnection between said mandrel sections, (b) inserting said set of mandrel sections into said pipe so that the set is located between a mandrel section stopping dent and a gripper end of said pipe with a largest diameter mandrel section nearest to said mandrel section stopping dent, with a smallest diameter mandrel section near said gripper end and without any spacing between neighboring mandrel sections, (c) drawing said pipe through drawing die means corresponding in number to said number of drawing mandrel sections, in a drawing direction such that said gripper end passes first through a nozzle of said drawing die means, whereby all drawing mandrel sections, except the largest diameter mandrel section, travel along with the drawn pipe still substantially without any spacing between neighboring mandrel sections while said largest diameter pipe section is stopped by said drawing die means for a first diameter and pipe wall thickness reduction, and (d) denting said pipe with a denting tool that moves along with said pipe while said pipe is being drawn, said denting taking place in a zone of already reduced pipe wall thickness downstream of the respective drawing die means yet close to the drawing mandrel section which last passed through the preceding drawing die means, whereby hollow drawing is kept optimally low, and so that said denting is completed at the latest when said drawing step is completed.

2. The method of claim 1, wherein prior to said inserting step said gripper end is formed whereupon said drawing mandrel sections, smallest diameter first largest diameter last, are inserted into said pipe, and then forming a first dent behind the largest diameter mandrel section, so that said mandrel sections are located between said dent and said gripper end.

3. The method of claim 1, wherein prior to said inserting step a first dent is formed in said pipe whereupon said drawing mandrel sections, largest diameter first smallest diameter last, are inserted into said pipe, so that said largest diameter mandrel section is stopped against said dent, and then forming said gripper end so that said mandrel sections are located between said dent and said gripper end.

4. The method of claim 1, wherein each of said drawing steps comprises a drawing-in stroke (13) for each of said drawing die means.

5. The method of claim 2, wherein said denting step is performed by contacting said pipe with a tiltable denting means and tilting said denting means simultaneously with said drawing at least during a portion of said drawing.

6. The method of claim 5, wherein said tilting of said denting means begins at the earliest when a hollow drawn portion of said pipe has passed said denting means so that a dent is formed in a reduced wall thickness portion of said pipe.

7. An apparatus for straight drawing a pipe to reduce the pipe diameter and pipe wall thickness, comprising machine frame means, a plurality of drawing die means each with a drawing nozzle mounted in said machine frame means in axial alignment with each other in a straight drawing direction, said drawing die means including a drawing slide for each drawing die means, denting means for forming dents in said pipe, said denting means being arranged individually for each drawing die means, a set of drawing mandrel sections corresponding in number to said plurality of drawing die means, each of said mandrel sections being without any interconnection to its neighboring mandrel section and without any spacing between neighboring mandrel sections until a spacing is formed when the largest diameter mandrel section is retained by the respective die means, each of said denting means comprising at least one denting tool, first drive means operatively mounted in said machine frame for drawing said pipe through said drawing die means, whereby smaller diameter mandrel sections travel along with the pipe being drawn still without any spacing between neighboring smaller diameter mandrel sections, second drive means for operating said denting tool in such a synchronism with said drawing means that said denting tool is operated at the earliest when a hollow drawn portion of said pipe has passed said denting tool, said first drive means including intermittent drive means for moving each drawing slide in said straight drawing direction, and wherein said second drive means and said intermittent drive means cooperate with each other so that in response to an intermittent drawing stroke of said drawing slide a dent is formed during said intermittent drawing stroke and completed at the latest when a drawing stroke is completed.

8. The apparatus of claim 7, wherein said drawing die means comprise drawing plates each mounted on its respective drawing slide.

9. The apparatus of claim 7, wherein said denting means comprise a denting stroke head, and two denting tools mounted opposite to each other to said denting stroke head, and means for moving said denting stroke head substantially radially relative to said drawing direction.

10. The apparatus of claim 9, wherein said means for moving said denting stroke head comprise straight guide means (23) secured to said machine frame means for movably guiding said denting stroke head in a direction substantially perpendicularly to said drawing direction, and a straight drive (24) arranged for driving said denting stroke head back and forth along said straight guide means.

11. The apparatus of claim 9, further comprising tilting mounting means (25, 26, 28, 29, 30, 30') for tiltably mounting said two denting tools to said denting stroke head, whereby said two denting tools are arranged opposite each other.

12. The apparatus of claim 11, wherein said tilting drive means comprise two tilting shafts, one for each of said two denting tools, said tilting shafts having axes arranged in parallel to each other and extending perpendicularly to a plate which extends through said pipe so that a longitudinal pipe axis is located in said plane.

13. The apparatus of claim 12, wherein said tilting drive means comprise two gear rim segments (28, 29) mounted on said tilting shafts and meshing with each other, whereby said two denting tools are driven in synchronism with each other, but in opposite directions.

14. The apparatus of claim 13, further comprising tilting drive means (30, 30') connected to one of said gear rim segments for tilting both of said meshing gear rim segments.

* * * * *

UNITED STATES PATENT AND TRADEMARK OFFICE

CERTIFICATE OF CORRECTION

PATENT NO. : 4,962,658

DATED : October 16, 1990

INVENTOR(S) : Karl-Heinz Komp

It is certified that error appears in the above-identified patent and that said Letters Patent is hereby corrected as shown below:

In the abstract [57], line 15, replace "dimeter" by --diameter--;

In claim 12, line 5, column 9, line 1, replace "plate" by --plane--.

Signed and Sealed this

Fourteenth Day of January, 1992

*Attest:*

HARRY F. MANBECK, JR.

*Attesting Officer*

*Commissioner of Patents and Trademarks*